United States Patent [19]

Gregory

[11] Patent Number: 4,489,471

[45] Date of Patent: Dec. 25, 1984

[54] HYDRAULIC PULLING TOOL

[75] Inventor: Jack T. Gregory, Penngrove, Calif.

[73] Assignee: Gregory Tool Systems, Inc., Sonoma, Calif.

[21] Appl. No.: 556,920

[22] Filed: Dec. 1, 1983

[51] Int. Cl.[3] ..... B21J 15/06

[52] U.S. Cl. ..... 29/243.52; 29/252; 72/391

[58] Field of Search ..... 29/243.52, 243.53, 243.54, 29/243.5, 252; 72/391, 453.19, 453.07

[56] References Cited

U.S. PATENT DOCUMENTS 3,164,283 1/1965 Olson ..... 29/252

3,934,325 1/1976 Jaffe ..... 29/243.52

4,187,708 2/1980 Champoux ..... 29/243.52

*Primary Examiner*—Robert C. Watson

*Attorney, Agent, or Firm*—Melvin R. Stidham

[57] ABSTRACT

A hydraulic pulling tool comprising a piston slidable within a cylinder and having a co-axial bore therein. Lateral passages open from the bore through the piston to the leading face thereof and a screw piston is pushed in the bore by threading a screw pusher so that the hydraulic fluid in the bore is forced out into the cylinder to retract the piston. For a blind riveter, a pair of jaws is driven by a pusher piston also carried at the leading end of the bore so that the build up of pressure causes the jaws to grip a blind rivet firmly.

4 Claims, 3 Drawing Figures

HYDRAULIC PULLING TOOL

BACKGROUND OF THE INVENTION

There are available a number of manually operated hydraulic force-applying tools such as those shown in my U.S. Pat. Nos. 4,031,619 granted June 28, 1977, 4,263,801 granted Apr. 28, 1981, 4,248,077 granted Feb. 3, 1981, 4,342,216 granted Aug. 3, 1982 and 4,329,121 granted May 11, 1982. Generally, these are self-contained tools that include pump-operated plungers to generate pressure and an array of one-way check valves to control direction of pressure application. There continues a need for a force-applying tool that gains the mechanical advantage available through the assertion of hydraulic pressures over differential areas in a very simple construction that eliminates the need for pumps and complex valving.

OBJECTS OF THE INVENTION

It is an object of this invention to provide a hydraulic pulling tool that is extremely simple in construction but reliable in operation.

It is a further object of this invention to provide a hydraulic pulling tool that can be operated with conventional hand tools.

Other objects and advantages of this invention will become apparent from the description to follow, particularly when read in conjunction with the accompanying drawing.

SUMMARY OF THE INVENTION

In carrying out this invention, a base or anchor member is provided on the end of a cylinder and a pulling member is provided on an extension of a piston slidable within the cylinder. Lateral passages open from a coaxial bore through the piston rod into the cylinder, ahead of the piston so that, by pushing a plunger through the bore, hydraulic fluid within the bore is forced out to drive the piston. The plunger may simply be a screw member to be driven by a hand-held power wrench. In one embodiment, the pulling device comprises a riveter wherein jaws for gripping the rivet are forced into a wedged collar by a second pusher piston carried at the forward end of the coaxial bore so that, pressure applied to retract the main piston also operates to actuate the jaws.

DESCRIPTION OF PREFERRED EMBODIMENTS

Figure 1:
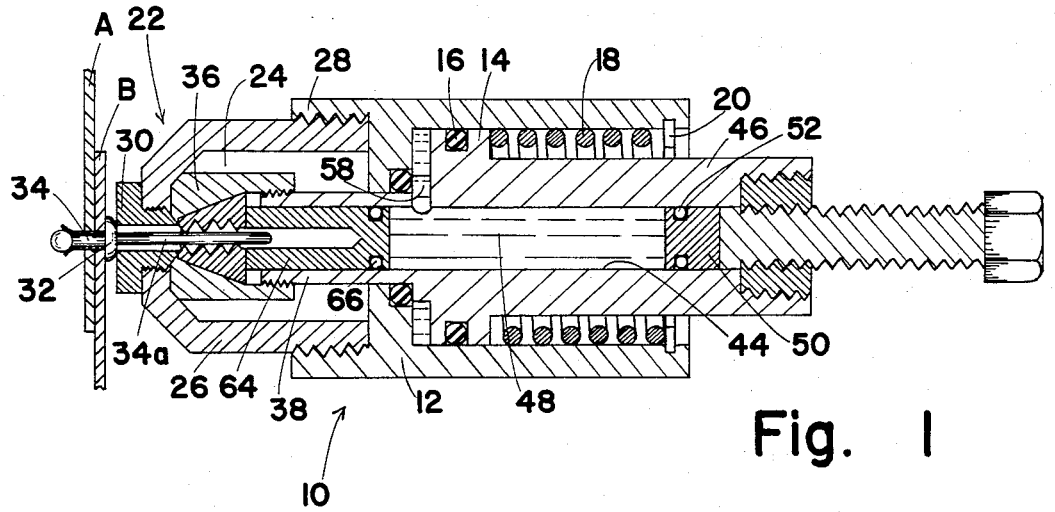
FIG. 1 is a section view of a blind riveter embodying features of this invention in its retracted position.
Figure 2:
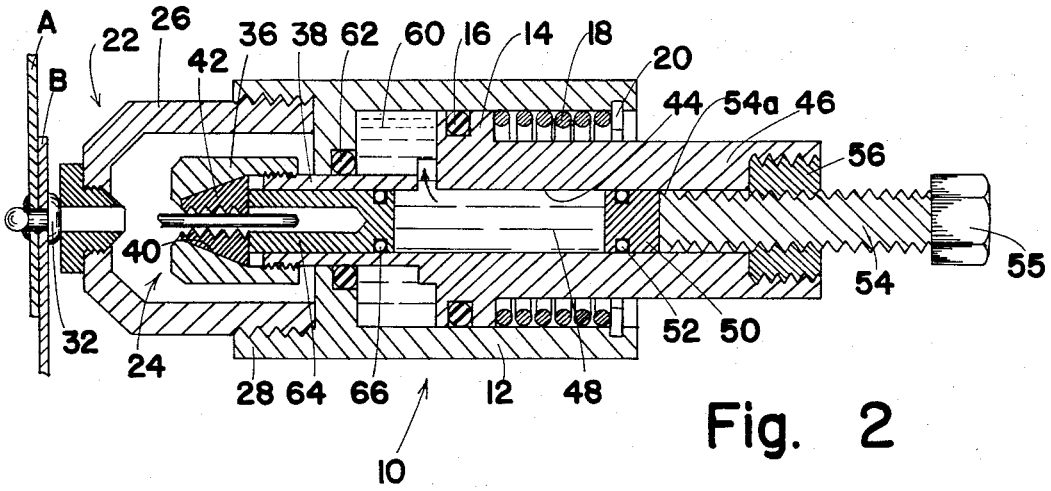
FIG. 2 is a section view of the riveter in its extended position.

The Embodiment of FIGS. 1 and 2

Referring to FIGS. 1 and 2 with greater particularity, a blind riveter 10 embodying features of this invention includes a cylinder 12, within which is slidably received a piston 14. A suitable seal ring, such as an O-ring 16, is provided to seal around the piston 14 so that the piston may be driven to the right under hydraulic pressure. The piston is normally biased toward the left to the position shown in FIG. 1 by means of a strong spring 18 pushing against a split ring 20 carried in the cylinder 12.

An anvil assembly 22 is carried on the cylinder 12 and a gripping and pulling mechanism 24 is carried on the piston 14, so that the cylinder can anchor one workpiece while the piston pulls the other. The assembly 22 includes a nose tube 26 which is threaded or otherwise secured to an annular extension 28 on the cylinder and a nose piece 30 which is positioned to press against the head 32 of a blind rivet 34, in order to secure workpieces A and B together.

The pulling assembly 24 includes a jar collet 36 which is threaded or otherwise secured to a cylindrical extension 38 of the piston 14. The collet 36 has conical or wedging inner surfaces 40 that are engaged by complementary surfaces on jaws 42 so that, as the jaws are forced outward, or to the left in FIG. 1, they firmly grip the shank **34*a* of the blind rivet 34 so that it may be pulled until the rivet is set and severed, as shown in FIG. 2**.

A coaxial bore 44 extends through the piston rod 46 to be filled with a charge of hydraulic fluid 48. A free transfer piston 50, which is sealed at 52, is slidable in the bore 44 to be forced to the left by means of a screw pusher 54, which may be engaged at 55 by a conventional tool such as a power impact wrench (not shown). The screw 54 is threaded into a nut 56 carried at the end of the piston rod 46. One or more lateral passageways 58 open from the coaxial bore 44 into the interior 60 of the cylinder in advance of the main piston 14. An O-ring 62 seals around the piston extension 38, to make the cylinder 60 fluid tight.

Also slidably carried in the bore 44 is a jaw pusher piston 64 that is sealed at 66 to be biased by fluid pressure against the jaws 42, driving them against the conical surfaces 40 to clamp them tightly around the stem **34*a*** of the blind rivet.

In operation, the blind riveter 10 is held against the rivet 32, holding it against the workpieces A and B, and a suitable tool, such as an impact wrench (not shown), is applied to drive the screw 54 by engagement at the head 55. This pushes the transfer piston 50 to increase pressure of the hydraulic fluid 48 which, in turn, drives the jaw pusher piston 64 to clamp the jaws and also passes through lateral passageways 48 into the cylinder 60 to force the main piston 14 to the right against the action of the heavy spring 18. In a matter of just a few seconds, the rivet can be set and severed. Then, the power wrench may be reversed to retract the screw 54. A suitable stop member **54*a* is provided on the screw 54 to prevent complete withdrawal of the screw. The reduction of pressure with retraction of the screw 54 enables the spring 18 to drive the piston 14 forward, and residual fluid pressure will force the transfer piston 50 back against the end of the screw 54 for another cycle, after the severed stem 34*a*** of the rivet is dropped.

Figure 3:
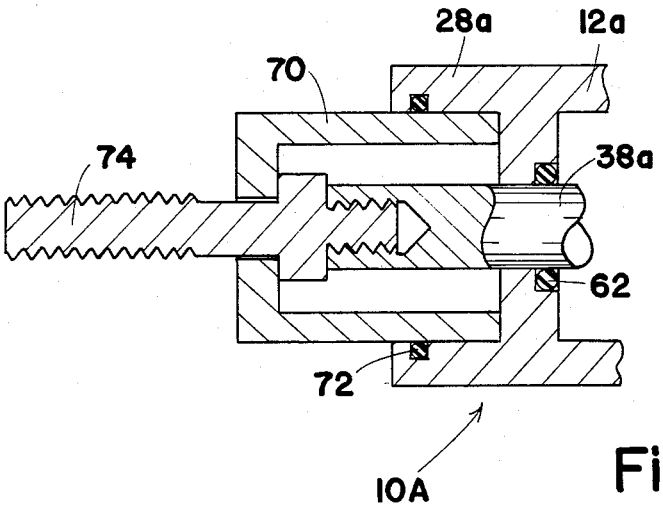
FIG. 3 is a partial section view of another form of pulling tool.

The Embodiment of FIG. 3

FIG. 3 illustrates the adaptation of the tool as a pulling device for installing threaded blind fasteners. There, an anvil 70 may be friction-gripped by an O-ring 72 carried in an annular extension **28*a* on the cylinder 12*a*, after a pull-up stud 74 is threaded into the end of an extension 38*a* of the piston. In operation, the extension 38*a* is pulled to the right to crimp a threaded blind fastener into which the stud 54** has been threaded.

While this invention has been described in conjunction with preferred embodiments thereof, it is obvious that modifications and changes therein may be made by those skilled in the art to which it pertains, without departing from the spirit and scope of this invention, as defined by the claims appended hereto.

What is claimed as invention is:

1. A hydraulic pulling tool comprising:
a cylinder;
a main piston slidable in said cylinder;
an axial bore extending into said main piston;
a plunger slidable in said bore;
at least one port opening from said bore to the leading face of said main piston;
an extension on the leading end of said main piston extending through the head of said cylinder;
work-piece gripping means on said extension;
mechanical means for forcing said plunger into said bore; and
means biasing said main piston toward said cylinder head.

2. The hydraulic pulling tool defined by claim 1 wherein said plunger comprises:
a free transfer piston slidable in said bore;
internal threads in said bore at the trailing end thereof; and
a threaded pusher engaging behind said transfer piston.

3. The hydraulic pulling tool defined by claim 1 wherein said gripping means comprises:
a collar with a conical inner surface carried on the leading end of said extension;
at last two jaws having complementary conical outer surfaces axially movable in said collar; and
a jaw pusher piston slidable in said bore so that fluid pressure behind said pusher piston forces said complementary conical surfaces together.

4. The hydraulic pulling tool defined by claim 1 wherein said gripping means comprises:
a screw threaded into the body end of a said extension and adapted to engage a threaded blind fastener;
and including:
an anvil sleeve with a flat leading face carried on said cylinder; and
means forming an opening through said leading face through which said screw extends.

* * * * *